US008555975B2

(12) United States Patent
Dykstra et al.

(10) Patent No.: US 8,555,975 B2
(45) Date of Patent: Oct. 15, 2013

(54) EXIT ASSEMBLY WITH A FLUID DIRECTOR FOR INDUCING AND IMPEDING ROTATIONAL FLOW OF A FLUID

(75) Inventors: Jason D. Dykstra, Carrollton, TX (US); Michael L. Fripp, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 402 days.

(21) Appl. No.: 12/974,212

(22) Filed: Dec. 21, 2010

(65) Prior Publication Data

US 2012/0152527 A1 Jun. 21, 2012

(51) Int. Cl.
*E21B 43/12* (2006.01)
*F15C 1/16* (2006.01)

(52) U.S. Cl.
USPC ..... 166/316; 166/373; 137/809; 137/813

(58) Field of Classification Search
USPC ..... 166/316, 319, 373, 386, 223; 137/809, 137/813, 812, 804, 805, 810, 815, 823, 837, 137/838, 806, 829, 830, 834
See application file for complete search history.

(56) References Cited

U.S. PATENT DOCUMENTS 553,727 A * 1/1896 Van Sickle ..... 239/474
3,267,946 A * 8/1966 Adams et al. ..... 137/813
3,566,900 A 3/1971 Black
3,586,104 A 6/1971 Hyde
3,620,238 A 11/1971 Kawabata
3,712,321 A 1/1973 Bauer
4,276,943 A 7/1981 Holmes
4,323,991 A 4/1982 Holmes et al.
4,418,721 A 12/1983 Holmes
4,557,295 A 12/1985 Holmes
4,895,582 A 1/1990 Bielefeldt
5,076,327 A 12/1991 Mettner
6,497,252 B1 12/2002 Kohler et al.

(Continued)

FOREIGN PATENT DOCUMENTS

WO WO 2010053378 A2 5/2010
WO WO 2010087719 A1 8/2010

(Continued)

OTHER PUBLICATIONS

Angrist, Fluid Control Devices, Scientific American, Dec. 1964, pp. 80-88, USA.

(Continued)

*Primary Examiner* — Shane Bomar
*Assistant Examiner* — Wei Wang
(74) *Attorney, Agent, or Firm* — Paul Herman; Sheri Higgins Law; Sherri Higgins

(57) ABSTRACT

According to an embodiment, an exit assembly comprises: a first fluid inlet; a first fluid outlet; and at least one fluid director, wherein the fluid enters the exit assembly in one direction, in another direction, or combinations thereof, and wherein the at least one fluid director induces flow of the fluid rotationally about the assembly when the fluid enters in the one direction and impedes flow of the fluid rotationally about the assembly when the fluid enters in the another direction. In another embodiment, the exit assembly includes two or more fluid inlets. According to another embodiment, a flow rate restrictor comprises: a fluid switch; and the exit assembly. According to another embodiment, the flow rate restrictor is for use in a subterranean formation.

30 Claims, 10 Drawing Sheets

(56) References Cited

U.S. PATENT DOCUMENTS

| | | | |
|---|---|---|---|
| 7,828,067 | B2 | 11/2010 | Scott et al. |
| 2009/0120647 | A1 | 5/2009 | Turick et al. |
| 2011/0042092 | A1 | 2/2011 | Fripp et al. |
| 2011/0198097 | A1 | 8/2011 | Moen |

FOREIGN PATENT DOCUMENTS

| | | | |
|---|---|---|---|
| WO | WO 2011041674 | A2 | 4/2011 |
| WO | WO 2011095512 | A2 | 8/2011 |
| WO | WO 2011115494 | A1 | 9/2011 |

OTHER PUBLICATIONS

Wright et al., The Development and Application of HT/HP Fiber Optic Connectors for Use on Subsea Intelligent Wells, OTC 15323, May 2003, pp. 1-8, For Presentation in 2003 OTC Conference in Houston, Texas, USA.

Freyer et al., An Oil Selective Inflow Control System, SPE 78272, Oct. 2002, pp. 1-8, For Presentation in 2002 SPE Conference in Aberdeen, Scotland, U.K.

* cited by examiner

EXIT ASSEMBLY WITH A FLUID DIRECTOR FOR INDUCING AND IMPEDING ROTATIONAL FLOW OF A FLUID

TECHNICAL FIELD

An exit assembly includes at least one fluid director that induces flow of the fluid rotationally about the assembly when the fluid enters in one direction and impedes flow of the fluid rotationally about the assembly when the fluid enters in another direction. In another embodiment, the exit assembly has a plurality of fluid inlets. According to another embodiment, the exit assembly is used in a flow rate restrictor. In another embodiment, the flow rate restrictor is used in a subterranean formation.

SUMMARY

According to an embodiment, an exit assembly comprises: a first fluid inlet; a first fluid outlet; and at least one fluid director, wherein the fluid enters the exit assembly in one direction, in another direction, or combinations thereof, and wherein the at least one fluid director induces flow of the fluid rotationally about the assembly when the fluid enters in the one direction and impedes flow of the fluid rotationally about the assembly when the fluid enters in the another direction.

According to another embodiment, a flow rate restrictor comprises: a fluid switch; an exit assembly comprising: (1) a first fluid inlet; (2) a first fluid outlet; and (3) at least one fluid director, wherein the fluid switch causes the fluid to enter the exit assembly in one direction, in another direction, or combinations thereof, and wherein the at least one fluid director induces flow of the fluid rotationally about the assembly when the fluid enters in the one direction and impedes flow of the fluid rotationally about the assembly when the fluid enters in the another direction.

BRIEF DESCRIPTION OF THE FIGURES

The features and advantages of certain embodiments will be more readily appreciated when considered in conjunction with the accompanying figures. The figures are not to be construed as limiting any of the preferred embodiments.

DETAILED DESCRIPTION

Figure 1:
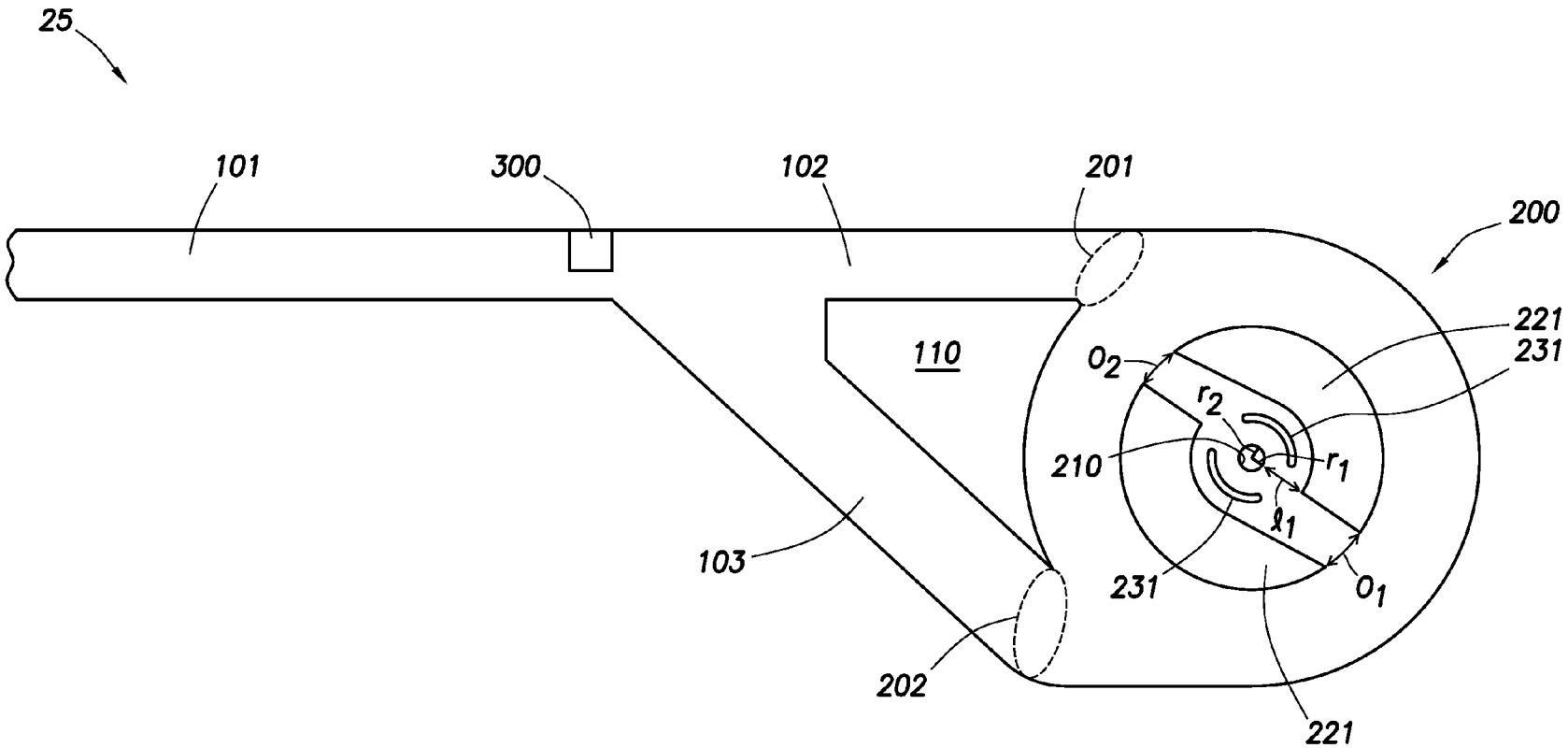
FIG. 1 is a flow rate restrictor according to an embodiment comprising the exit assembly.

As used herein, the words "comprise," "have," "include," and all grammatical variations thereof are each intended to have an open, non-limiting meaning that does not exclude additional elements or steps.

It should be understood that, as used herein, "first," "second," "third," etc., are arbitrarily assigned and are merely intended to differentiate between two or more passageways, inlets, etc., as the case may be, and does not indicate any particular orientation or sequence. Furthermore, it is to be understood that the mere use of the term "first" does not require that there be any "second," and the mere use of the term "second" does not require that there be any "third," etc.

As used herein, a "fluid" is a substance having a continuous phase that tends to flow and to conform to the outline of its container when the substance is tested at a temperature of 71° F. (22° C.) and a pressure of one atmosphere "atm" (0.1 megapascals "MPa"). A fluid can be a liquid or gas. A homogenous fluid has only one phase, whereas a heterogeneous fluid has more than one distinct phase. A colloid is an example of a heterogeneous fluid. A colloid can be: a slurry, which includes a continuous liquid phase and undissolved solid particles as the dispersed phase; an emulsion, which includes a continuous liquid phase and at least one dispersed phase of immiscible liquid droplets; a foam, which includes a continuous liquid phase and a gas as the dispersed phase; or a mist, which includes a continuous gas phase and liquid droplets as the dispersed phase. As used herein, the "viscosity" is the dissipative behavior of fluid flow and includes, but is not limited to, kinematic viscosity, shear strength, yield strength, surface tension, viscoplasticity, and thixotropicity.

Oil and gas hydrocarbons are naturally occurring in some subterranean formations. A subterranean formation containing oil or gas is sometimes referred to as a reservoir. A reservoir may be located under land or off shore. Reservoirs are typically located in the range of a few hundred feet (shallow reservoirs) to a few tens of thousands of feet (ultra-deep reservoirs). In order to produce oil or gas, a wellbore is drilled into a reservoir or adjacent to a reservoir.

A well can include, without limitation, an oil, gas, water, or injection well. A well used to produce oil or gas is generally referred to as a production well. Fluid is often injected into a production well as part of the construction process or as part of the stimulation process. As used herein, a "well" includes at least one wellbore. A wellbore can include vertical, inclined, and horizontal portions, and it can be straight, curved, or branched. As used herein, the term "wellbore" includes any cased, and any uncased, open-hole portion of the wellbore. A near-wellbore region is the subterranean material and rock of the subterranean formation surrounding the wellbore. As used herein, a "well" also includes the near-wellbore region. The near-wellbore region is generally considered to be the region within about 100 feet of the wellbore. As used herein, "into a well" means and includes into any portion of the well, including into the wellbore or into the near-wellbore region via the wellbore.

A portion of a wellbore may be an open hole or cased hole. In an open-hole wellbore portion, a tubing string may be placed into the wellbore. The tubing string allows fluids to be introduced into or flowed from a remote portion of the wellbore. In a cased-hole wellbore portion, a casing is placed into the wellbore which can also contain a tubing string. A wellbore can contain an annulus. Examples of an annulus include, but are not limited to: the space between the wellbore and the outside of a tubing string in an open-hole wellbore; the space between the wellbore and the outside of a casing in a cased-hole wellbore; and the space between the inside of a casing and the outside of a tubing string in a cased-hole wellbore.

A wellbore can extend several hundreds of feet or several thousands of feet into a subterranean formation. The subterranean formation can have different zones. For example, one zone can have a higher permeability compared to another zone. Permeability refers to how easily fluids can flow through a material. For example, if the permeability is high, then fluids will flow more easily and more quickly through the subterranean formation. If the permeability is low, then fluids will flow less easily and more slowly through the subterranean formation. One example of a highly permeable zone in a subterranean formation is a fissure or fracture.

During production operations, it is common for an undesired fluid to be produced along with a desired fluid. For example, water production is when water (the undesired fluid) is produced along with oil or gas (the desired fluid). By way of another example, gas may be the undesired fluid while oil is the desired fluid. In yet another example, gas may be the desired fluid while water and oil are the undesired fluids. It is beneficial to produce as little of the undesired fluid as possible.

During enhanced recovery operations, an injection well can be used for water flooding. Water flooding is where water is injected into the reservoir to displace oil or gas that was not produced during primary recovery operations. The water from the injection well physically sweeps some of the remaining oil or gas in the reservoir to a production well. The enhanced recovery operations may also inject steam, carbon dioxide, acids, or other fluids.

In addition to the problem of undesired fluid production during recovery operations, the flow rate of a fluid from a subterranean formation into a wellbore may be greater in one zone compared to another zone. A difference in flow rates between zones in the subterranean formation may be undesirable. For an injection well, potential problems associated with enhanced recovery techniques can include inefficient recovery due to variable permeability in a subterranean formation and a difference in flow rates of a fluid from the injection well into the subterranean formation. A flow rate restrictor can be used to help overcome some of these problems.

A flow rate restrictor can be used to variably restrict the flow rate of a fluid. A flow rate restrictor can also be used to deliver a relatively constant flow rate of a fluid within a given zone. A flow rate restrictor can also be used to deliver a relatively constant flow rate of a fluid between two or more zones. For example, a restrictor can be positioned in a wellbore at a location for a particular zone to regulate the flow rate of the fluid within that zone. More than one restrictor can be used for a particular zone. Also, a restrictor can be positioned in a wellbore at one location for one zone and another restrictor can be positioned in the wellbore at one location for a different zone in order to regulate the flow rate of the fluid between two or more zones.

A novel exit assembly comprises at least one fluid director that: induces flow of a fluid rotationally about the assembly when the fluid enters in a first direction; and impedes flow of the fluid rotationally about the assembly when the fluid enters in a second direction. According to an embodiment, the exit assembly is used in a flow rate restrictor.

The exit assembly 200 does not need to be used in a flow rate restrictor. A flow rate restrictor is but one possible device the exit assembly could be used in. Applications for the exit assembly are not limited to oilfield applications, but also to pipelines, chemical plants, oil refineries, food processing, and automobiles.

According to an embodiment, an exit assembly comprises: a first fluid inlet; a first fluid outlet; and at least one fluid director. According to another embodiment, the exit assembly further comprises a second fluid inlet.

The fluid can be a homogenous fluid or a heterogeneous fluid.

Figure 2:
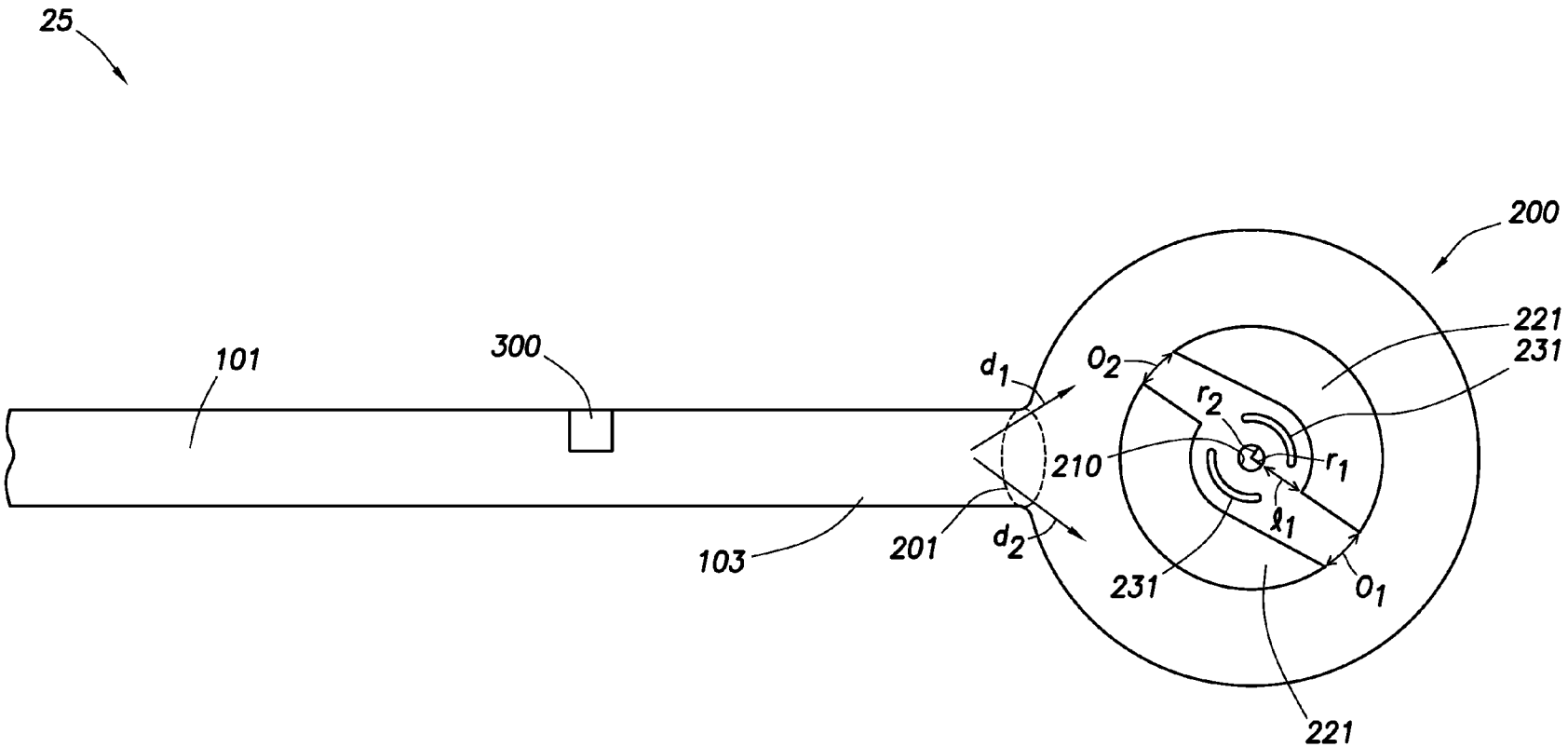
FIG. 2 is a flow rate restrictor according to another embodiment comprising the exit assembly.

Turning to the Figures, FIG. 1 is a diagram of a flow rate restrictor 25 according to an embodiment. FIG. 2 is a diagram of a flow rate restrictor 25 according to another embodiment. The flow rate restrictor 25 can include a first fluid passageway 101, a fluid switch 300, and an exit assembly 200. The exit assembly 200 will be described in more detail below. As shown in FIG. 1, the flow rate restrictor 25 can further include a second fluid passageway 102 and a third fluid passageway 103. The flow rate restrictor 25 can also include a branching point 110 wherein the first fluid passageway 101 can branch into the second and third fluid passageways 102 and 103 at the branching point 110. Although the Figures depict the second and third fluid passageways 102 and 103 connected to the first fluid passageway 101, it is to be understood that the second and third fluid passageways can be connected to other passageways instead. The second and third fluid passageways 102 and 103 can branch such that they are oriented substantially parallel to each other prior to connecting to the exit assembly 200. In this manner, the second and third fluid passageways 102 and 103 can branch such that they are oriented to cause the fluid to rotate in the ring region (not labeled) in opposite rotational directions. Any of the fluid passageways can be any shape including, tubular, rectangular, pyramidal, or curlicue in shape. Although illustrated as a single passageway, the first fluid passageway 101 (and any other passageway) could feature multiple passageways operationally connected in parallel.

As can be seen in FIG. 1, the first fluid passageway 101 can branch into the second and third fluid passageways 102 and 103 at the branching point 110. The first fluid passageway 101 can branch into the second and third fluid passageways 102 and 103 such that the second fluid passageway 102 branches at an angle of 180° with respect to the first fluid passageway 101. By way of another example, the second fluid passageway 102 can branch at a variety of angles other than 180° (e.g., at an angle of 45°) with respect to the first fluid passageway 101. The third fluid passageway 103 can also branch at a variety of angles with respect to the first fluid passageway 101. Preferably, if the second fluid passageway 102 branches at an angle of 180° with respect to the first fluid passageway 101, then the third fluid passageway 103 branches at an angle that is not 180° with respect to the first fluid passageway 101. In a preferred embodiment, the second and third fluid passageways 102 and 103, are oriented such that they attach to the exit assembly 200 tangential to the outer wall of the exit assembly 200.

The flow rate restrictor 25 includes a fluid switch 300. A fluid can enter the flow rate restrictor and travel through the first fluid passageway 101 towards the fluid switch 300. According to an embodiment, and as depicted in FIG. 1, the fluid switch 300 can direct the fluid into at least the second fluid passageway 102, the third fluid passageway 103, and combinations thereof. According to another embodiment, the fluid switch 300 directs a majority of the fluid into the second or third fluid passageways 102 or 103. According to yet another embodiment, and as depicted in FIG. 2, the fluid switch 300 can direct the fluid into the exit assembly 200 in the direction of $d_1$, $d_2$, and combinations thereof. The fluid switch 300 can be any type of switch that is capable of directing a fluid from one fluid passageway into two or more different fluid passageways or directing the fluid into the exit assembly 200 in two or more different directions. Examples of suitable fluid switches include, but are not limited to, a pressure switch, a mechanical switch, an electro-mechanical switch, a momentum switch, a fluidic switch, a bistable amplifier, and a proportional amplifier.

The fluid switch 300 can direct a fluid into two or more different fluid passageways or two or more different directions. In certain embodiments, the fluid switch 300 directs the fluid based on at least one of the physical properties of the fluid. In other embodiments, the fluid switch 300 directs the fluid based on an input from an external source. For example, an operator can cause the fluid switch 300 to direct the fluid. The at least one of the physical properties of the fluid can include, but is not limited to, the flow rate of the fluid in the first fluid passageway 101, the viscosity of the fluid, and the density of the fluid. By way of example, the fluid switch 300 can direct an increasing amount of the fluid into the second fluid passageway 102 when the flow rate of the fluid in the first fluid passageway 101 increases and can direct an increasing amount of the fluid into the third fluid passageway 103 when the flow rate of the fluid of the fluid in the first fluid passageway 101 decreases. By way of another example, the fluid switch 300 can direct an increasing amount of the fluid into the second fluid passageway 102 when the viscosity of the fluid decreases and can direct an increasing amount of the fluid into the third fluid passageway 103 when the viscosity of the fluid increases. By way of another example, the fluid switch 300 can direct an increasing amount of the fluid into the exit assembly 200 in the direction of $d_1$ when the flow rate of the fluid in the first fluid passageway 101 increases and can direct an increasing amount of the fluid into the exit assembly 200 in the direction of $d_2$ when the flow rate of the fluid of the fluid in the first fluid passageway 101 decreases.

Figure 3A:
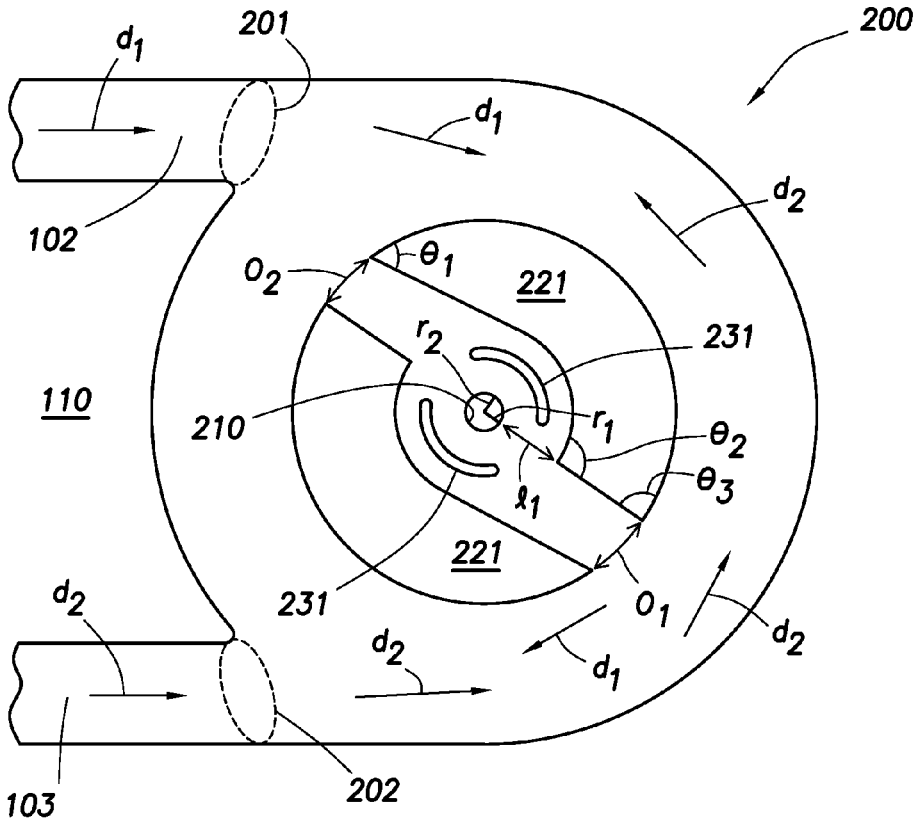
FIGS. 3A-3C depict the exit assembly according to an embodiment and flow of a fluid about the exit assembly.
Figure 4A:
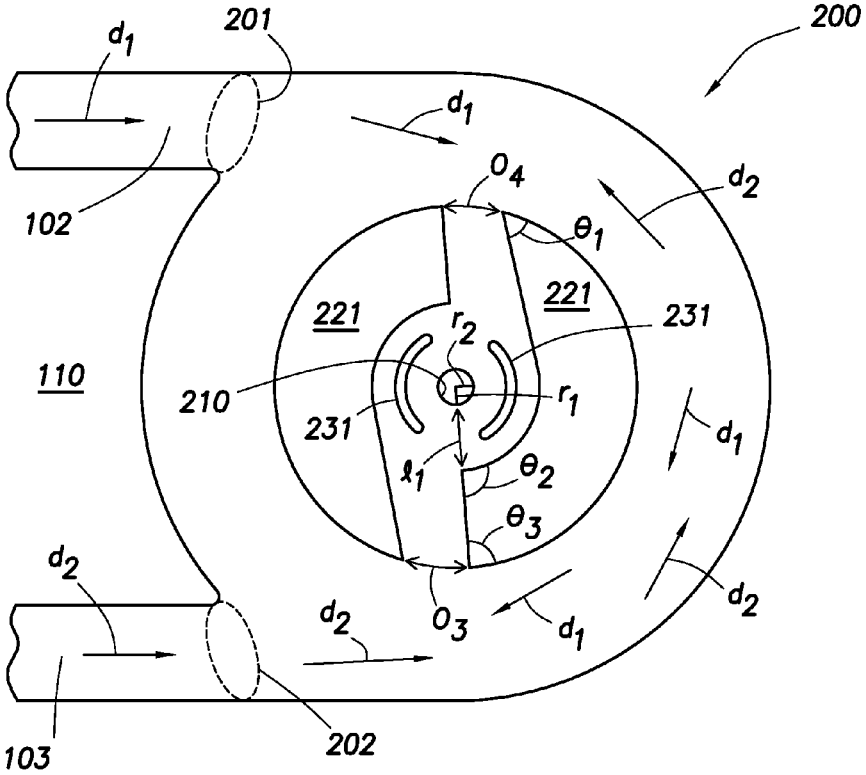
FIGS. 4A-4C depict the exit assembly according to another embodiment and flow of a fluid about the exit assembly.
Figure 5A:
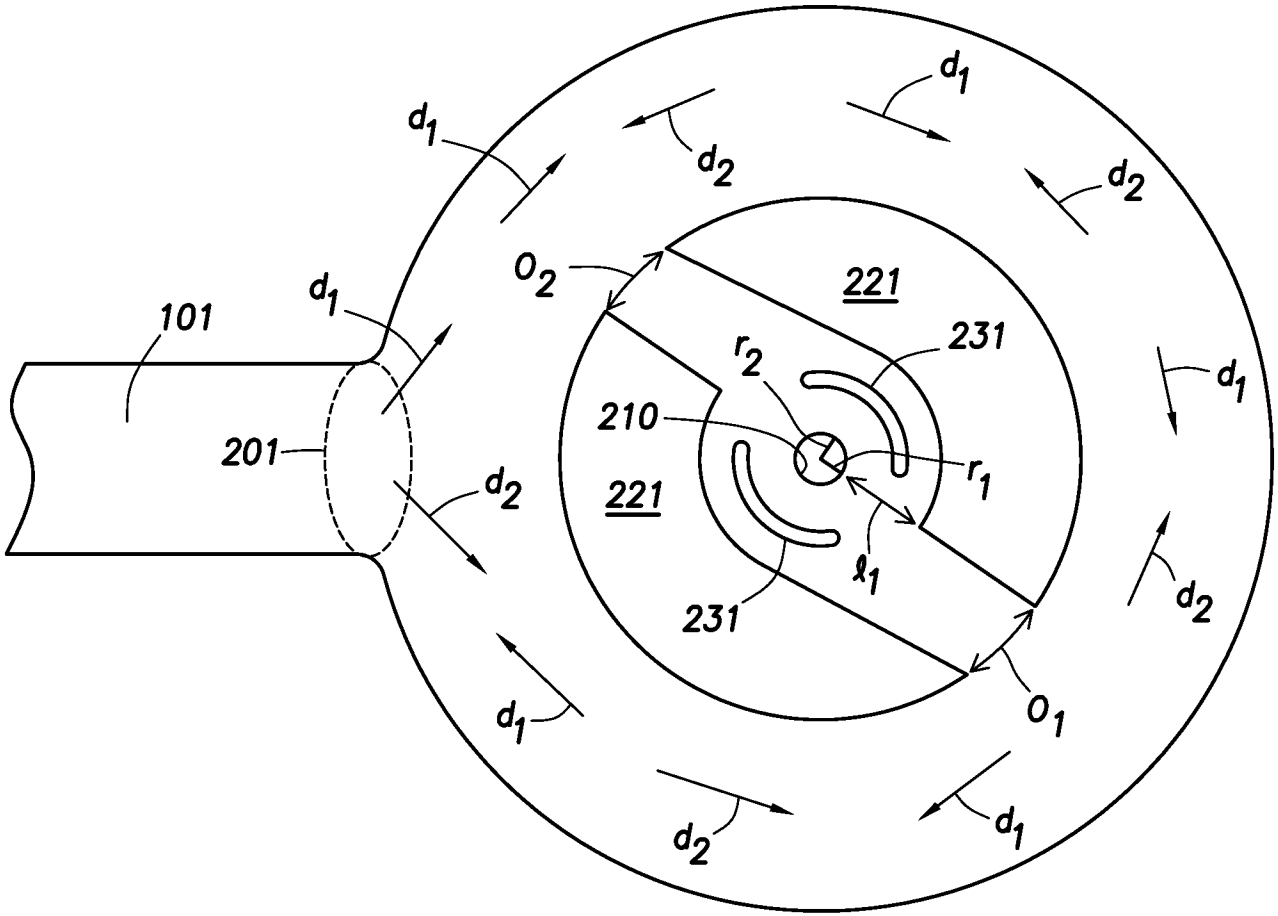
FIGS. 5A-5C depict the exit assembly for use in the flow rate restrictor illustrated in FIG. 2 and flow of a fluid about the exit assembly.

FIG. 3A depicts the exit assembly 200 according to an embodiment. FIG. 4A depicts the exit assembly 200 according to another embodiment. FIG. 5A depicts the exit assembly 200 according to another embodiment. The exit assembly 200 can include a first fluid inlet 201, a second fluid inlet 202, a first fluid outlet 210, and at least one fluid director 221. The exit assembly 200 can include only one fluid inlet and can also include more than two fluid inlets. The exit assembly 200 can also include more than one fluid outlet 210. According to another embodiment, the exit assembly includes at least two fluid directors 221.

When the fluid is directed into the second fluid passageway 102, the fluid can enter the exit assembly 200 via the first fluid inlet 201. When the fluid is directed into the third fluid passageway 103, the fluid can enter the exit assembly 200 via the second fluid inlet 202. Preferably, the fluid enters the exit assembly 200 tangentially relative to a radius of the first fluid outlet 210. According to an embodiment, when the fluid enters the exit assembly 200 via the first fluid inlet 201, the fluid flows about the exit assembly 200 in one direction and when the fluid enters the exit assembly 200 via the second fluid inlet 202, the fluid flows about the exit assembly 200 in another direction. By way of example, and as depicted in FIGS. 3A and 4A, when the fluid enters via the first fluid inlet 201, the fluid flows about the exit assembly 200 in the direction of $d_1$ and when the fluid enters via the second fluid inlet 202, the fluid flows about the exit assembly 200 in the direction of $d_2$. By way of another example, and as depicted in FIG. 5A, the fluid can enter the exit assembly 200 via the first fluid inlet 201 and can flow about the exit assembly 200 in the direction of $d_1$ and/or in the direction of $d_2$. According to these embodiment, the one direction is $d_1$ and the another direction is $d_2$.

As depicted in the Figures, the exit assembly 25 can include at least one fluid director 221 wherein an outer region exists between the inner wall of the exit assembly 200 and a boundary of the fluid director 221. According to another embodiment, at least one boundary of the fluid director 221 contacts the inner wall of the exit assembly 200 such that an outer region does not exist. Preferably, an inner region exists between at least one of the boundaries of the fluid director 221 and the first fluid outlet 210.

The fluid director(s) 221 can induce flow of a fluid rotationally about the inner region of the exit assembly 200. The fluid director(s) 221 can also impede flow of a fluid rotationally about the inner region of the assembly 200. According to an embodiment, the fluid director(s) 221 induces flow of a fluid rotationally about the assembly 200 when the fluid enters through the first fluid inlet 201 or in the direction of $d_1$; and impedes flow of the fluid rotationally about the assembly 200 when the fluid enters through the second fluid inlet 202 or in the direction of $d_2$. According to another embodiment, the size and shape of the fluid director(s) 221 is selected such that the fluid director(s) 221 induces flow of a fluid rotationally about the assembly 200 when the fluid enters through the first fluid inlet 201 or in the direction of $d_1$; and impedes flow of the fluid rotationally about the assembly 200 when the fluid enters through the second fluid inlet 202 or in the direction of $d_2$.

A preferred shape of the fluid director 221 for inducing and impeding flow of a fluid rotationally about the exit assembly 200 is shown in FIGS. 3A, 4A and 5A. There can be more than one fluid director 221. If at least two fluid directors 221 are used, the fluid directors do not have to be the same size or the same shape. Preferably, and as depicted in FIGS. 3A, 4A, 5A, 6 and 7, the exit assembly can include at least two fluid directors 221 having substantially the same size and shape. The shape of the fluid director 221 can be any shape that induces and impedes rotational flow of a fluid. It is to be understood that the shapes described herein, and depicted in the drawings are not the only shapes that are capable of achieving the desired result of inducing and impeding rotational flow of a fluid. Moreover, multiple shapes can be used within a given exit assembly 200. The fluid director 221 can include at least two boundaries. The fluid director 221 can also include at least three boundaries. Preferably, at least one of the boundaries induces flow of a fluid rotationally about the exit assembly 200. More preferably, two of the boundaries induce rotational flow of the fluid. For example, when the boundaries are straight, a first boundary can be oriented at an angle of less than 90° with respect to a second boundary. When at least one of the boundaries is curved, then the first boundary can be oriented at an angle of less than 90° with respect to the second boundary, wherein the angle is measured at a distance of less than one inch from where the first boundary joins the second boundary. This example is depicted in FIGS. 3A and 4A, where angle 1 ($\theta_1$) is less than 90°. Preferably, the first boundary is oriented at an angle ($\theta_1$) between 5° and 45° with respect to the second boundary. The at least one of the boundaries for inducing rotational flow can be aligned tangentially with respect to radii ($r_1$ and $r_2$) of the first fluid outlet 210. The boundaries of the fluid director 221 can join each other in a variety of ways. For example, the boundaries can include straight corners or rounded corners.

Preferably, another one of the boundaries impedes flow of a fluid rotationally about the exit assembly 200. For example, when the boundaries are straight, then a third boundary can be oriented at an angle between 60° and 90° with respect to the first boundary. The third boundary can also be oriented at an angle between 60° and 90° with respect to the second boundary. Preferably, the third boundary is oriented at an angle of 90° with respect to the first and second boundaries. When at least one of the boundaries is curved, then the third boundary can be oriented at an angle between 60° and 90° with respect to the first boundary and the second boundary, wherein the angle is measured at a distance of less than one inch from where the third boundary joins the first and second boundaries. This embodiment is depicted in FIGS. 3A and 4A, where angle 2 ($\theta_2$) and angle 3 ($\theta_3$) are each 90°. The boundary for impeding rotational flow of the fluid can be aligned with, or parallel to, a radius ($r_1$) of the first fluid outlet 210, shown as $\mathbf{1}_1$, it can also be aligned to the tangent of the first fluid outlet 210, it can be straight as shown in FIGS. 3A and 4A, it can be curved, and it can be any other configuration that serves to impede the rotational flow of the fluid about the assembly 200.

Figure 6:
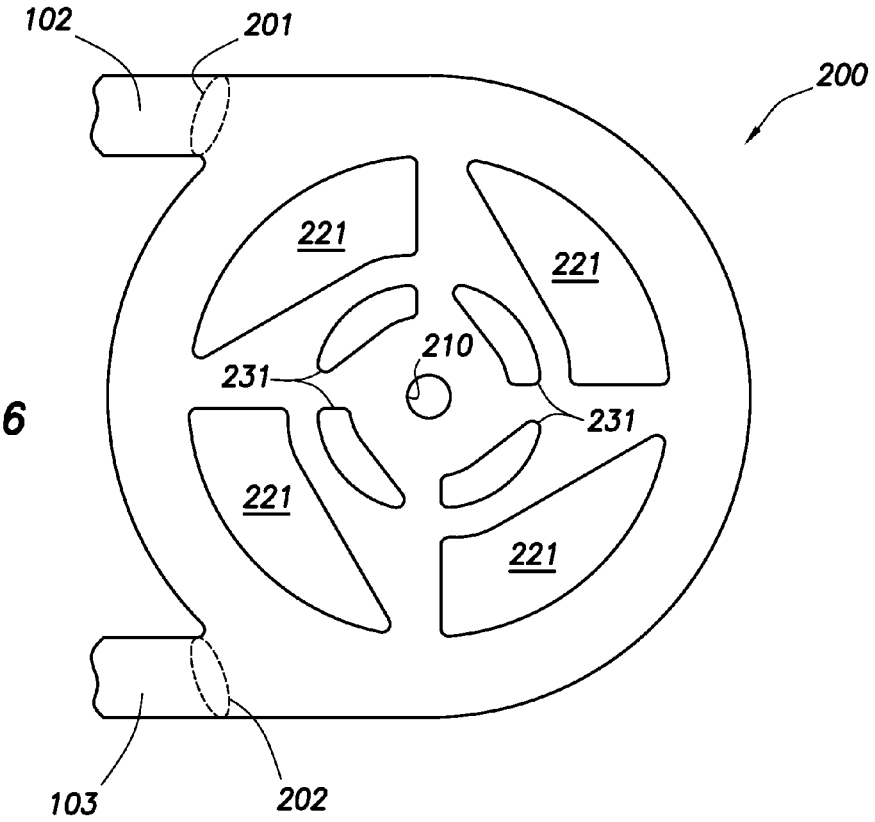
FIG. 6 illustrates a shape of fluid directors and flow directors according to an embodiment.

If the exit assembly includes more than one fluid director 221, then preferably, the at least one boundary that induces rotational flow of a fluid of a first fluid director 221 opposes the at least one boundary that impedes rotational flow of the fluid of a second fluid director 221. In the same manner, the at least one boundary that impedes rotational flow of the fluid of the first fluid director 221 opposes the at least one boundary that induces rotational flow of the fluid of the second fluid director 221. As depicted in FIG. 6, each of the boundaries that impedes rotational flow of the fluid oppose at least one other boundary that induces rotational flow of the fluid.

Preferably, there is at least one opening between a first and second fluid director 221. More preferably, there are at least two openings between a first and second fluid director 221. In another embodiment, there are more than two openings between more than two fluid directors 221. Any of the openings can be oriented in a variety of positions with respect to the first fluid inlet 201 or with respect to the first and second fluid inlets 201 and 202. FIGS. 3A and 4A depict two different examples of possible opening positions with respect to the first and second fluid inlets 201 and 202. As can be seen in FIGS. 3A and 4A, opening 1 ($O_1$) is positioned farther away from the second fluid inlet 202 compared to opening 3 ($O_3$), while opening 2 ($O_2$) is positioned closer to the first fluid inlet 201 compared to opening 4 ($O_4$). Each of the two openings (either openings 1 and 2 or openings 3 and 4), can be oriented in a variety of degrees, closer to or farther away from, the first and second fluid inlets 201 and 202. The two openings can be aligned substantially opposite of each other. The two openings can also be aligned at a multitude of other orientations. Preferably, the two openings can also be aligned such that they are at least partially off-set from each other.

Figure 7:
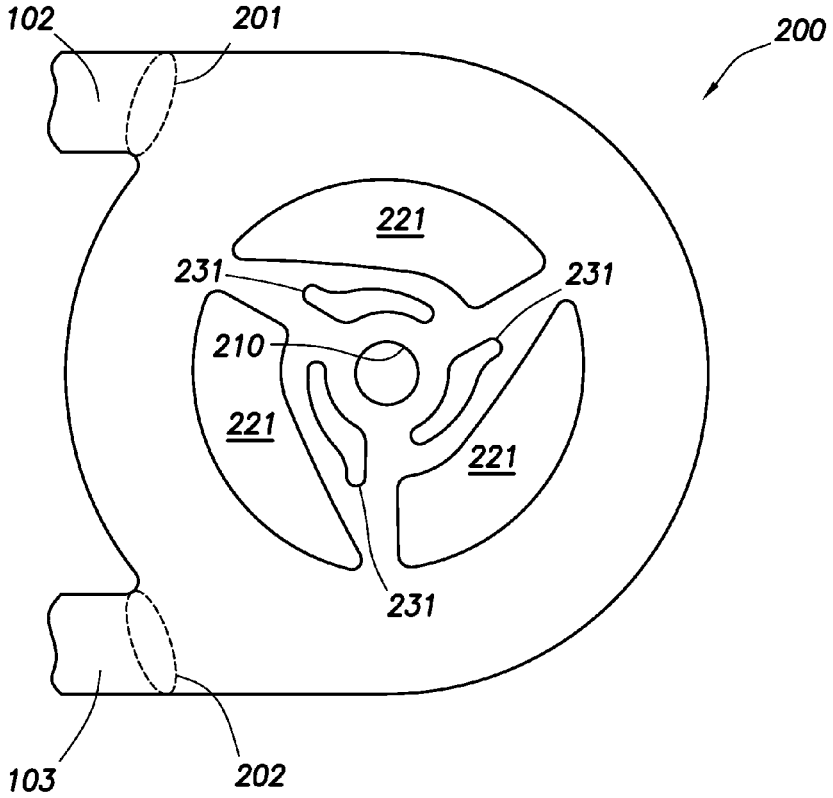
FIG. 7 illustrates a shape of fluid directors and flow directors according to another embodiment.

The exit assembly 200 can further include at least one flow director 231. There can be more than one flow director 231. Although not shown, there can be multiple flow directors 231 arranged in more than one circular pattern between the fluid director 221 and the first fluid outlet 210. According to an embodiment, the flow director(s) 231 helps to maintain a rotational flow of a fluid about the inner region of the exit assembly 200 and helps to maintain a non-rotational flow of a fluid about the inner region of the exit assembly 200. According to another embodiment, the flow director(s) 231 have a shape selected such that the flow director 231 helps to maintain a rotational flow of a fluid about the inner region and helps to maintain a non-rotational flow of a fluid about the inner region. The shape of the flow director(s) 231 can be substantially the same shape as the fluid director 221, or the shape can be different from the fluid director 221. FIGS. 3A, 4A, and 5A depict the flow director 231 having a different shape from the fluid director 221. FIG. 6 depicts a flow director 231 having substantially the same shape as the fluid director 221. FIG. 7 depicts the shape of a flow director 231 according to another embodiment.

Figure 3B:
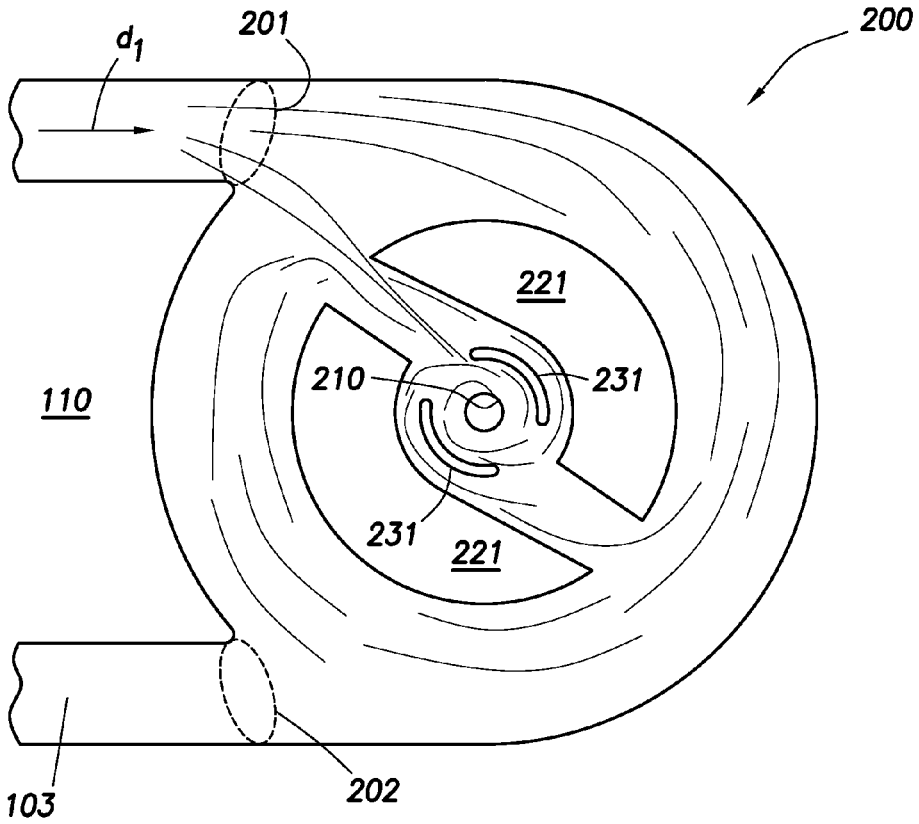
Figure 4B:
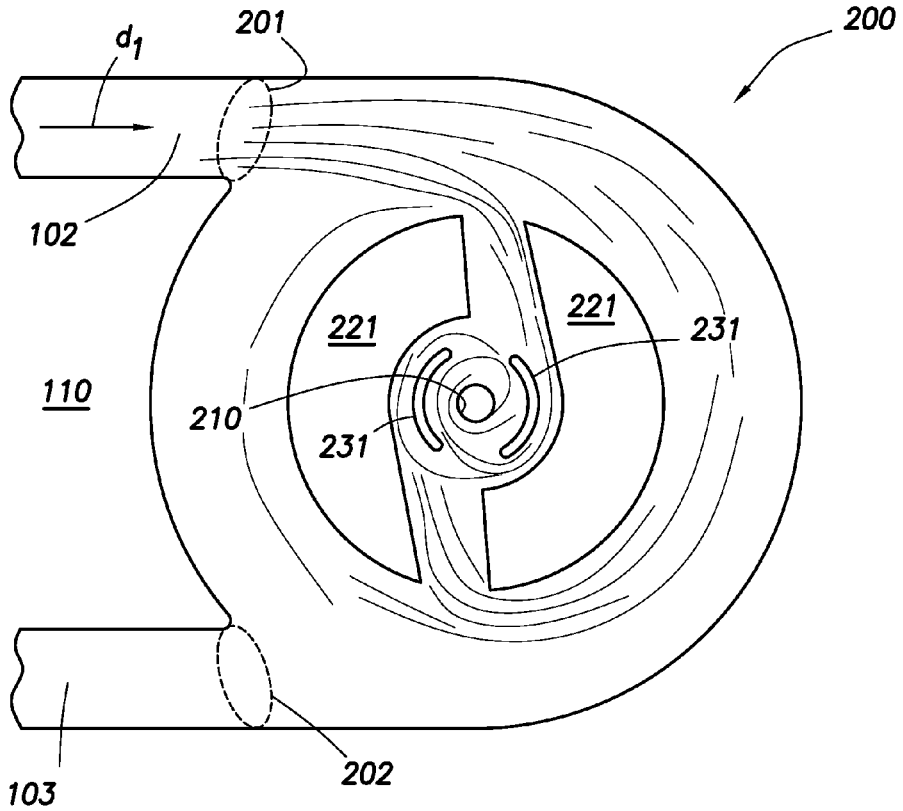
Figure 5B:
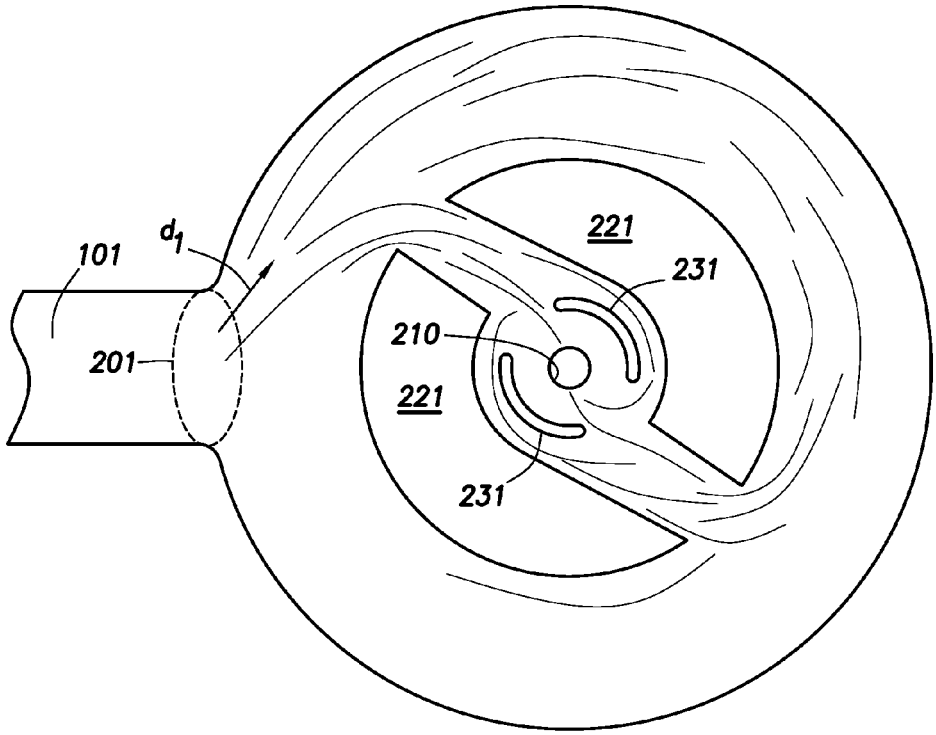

FIGS. 3B, 4B, and 5B illustrate certain embodiments of the flow of a fluid about the exit assembly 200 when at least some of the fluid enters the assembly 200 in the direction of $d_1$. As discussed above, the fluid can be directed into the second fluid passageway 102 by the fluid switch 300 and enter the exit assembly 200 via the first fluid inlet 201 and flow in the direction of $d_1$. As also discussed above, the fluid can enter the exit assembly 200 via the first fluid inlet 201 and flow in the direction of $d_1$. According to an embodiment, as the fluid increasingly flows in the direction of $d_1$, the fluid increasingly flows rotationally about the exit assembly 200. Accordingly, the fluid flows about the assembly 200 in one direction (depicted as $d_1$) and at least some of the fluid can contact the at least one boundary of the fluid director 221 that induces flow of the fluid rotationally about the assembly 200. If there is more than one fluid director 221, then some of the fluid can flow around a first fluid director 221 in the outer region and at least some of that fluid can contact the boundary of a second fluid director 221 that induces flow of the fluid rotationally about the assembly 200. The fluid that contacts the boundary(ies) that induces rotational flow, can enter a space between the boundary(ies) and the first fluid outlet 210. The fluid can also flow rotationally about the first fluid outlet 210 in the inner region. While not required, the exit assembly 200 can also include at least one flow director 231. The flow director 231 can be positioned in the inner region. In this manner, the fluid that enters the inner region, can contact at least one boundary of the flow director 231. The flow director 231 can help maintain the flow of the fluid rotationally about the first fluid outlet 210. The fluid director 221 and the flow director 231 can increase the rotational flow of the fluid about the exit assembly 200 and/or about the first fluid outlet 210.

According to an embodiment, as the fluid increasingly flows rotationally about the exit assembly 200, the resistance to flow of the fluid through the assembly 200 increases. According to another embodiment, as the fluid increasingly flows rotationally about the first fluid outlet 210, the resistance to flow of the fluid through the outlet 210 increases.

Figure 3C:
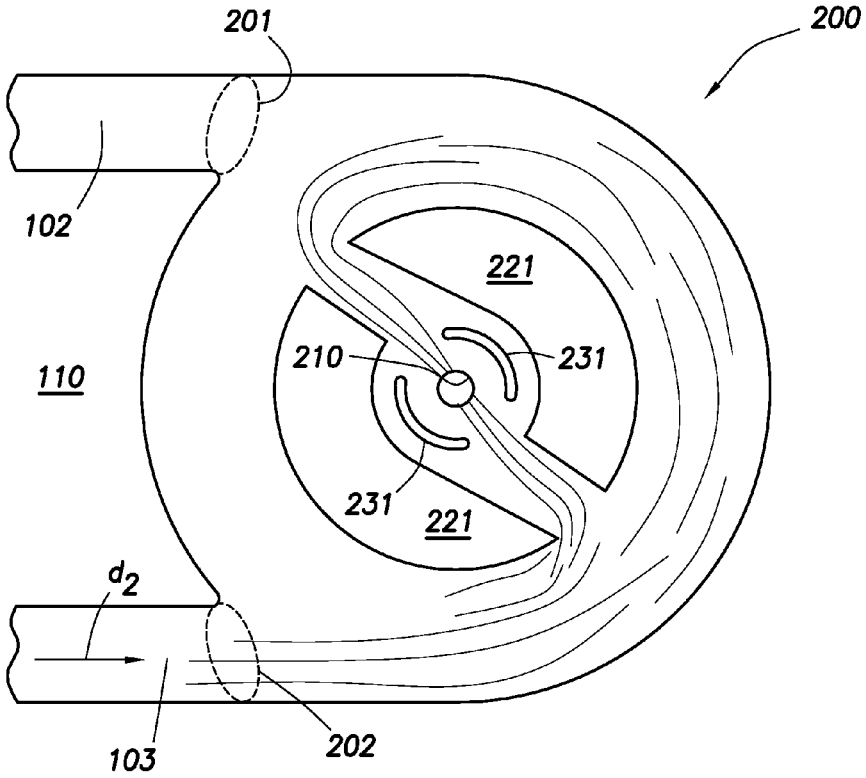
Figure 4C:
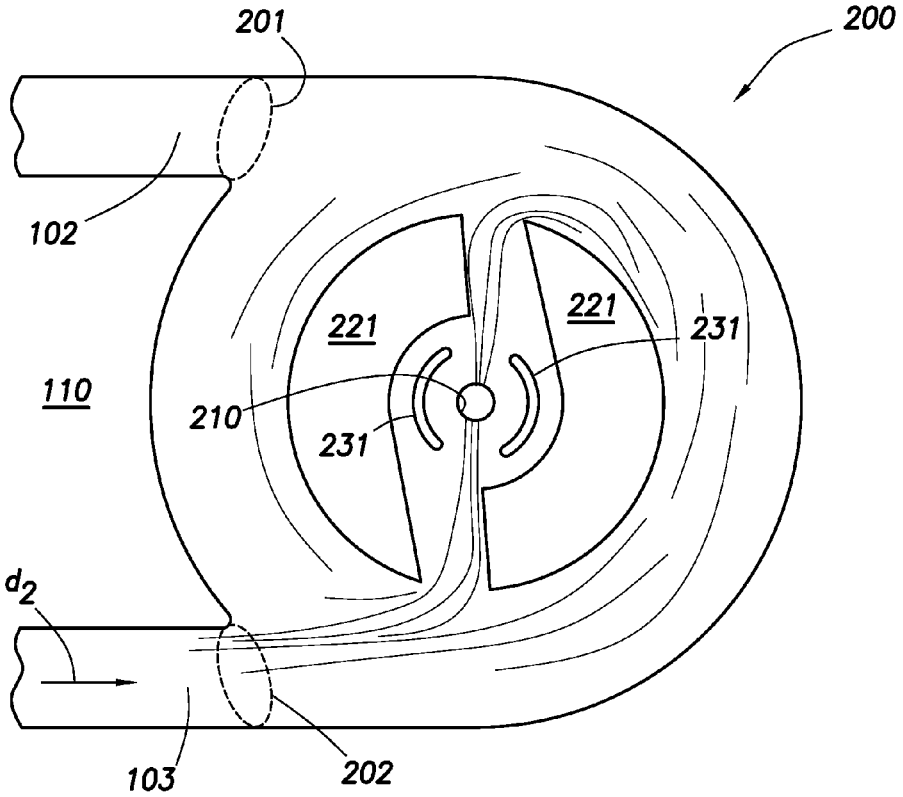
Figure 5C:
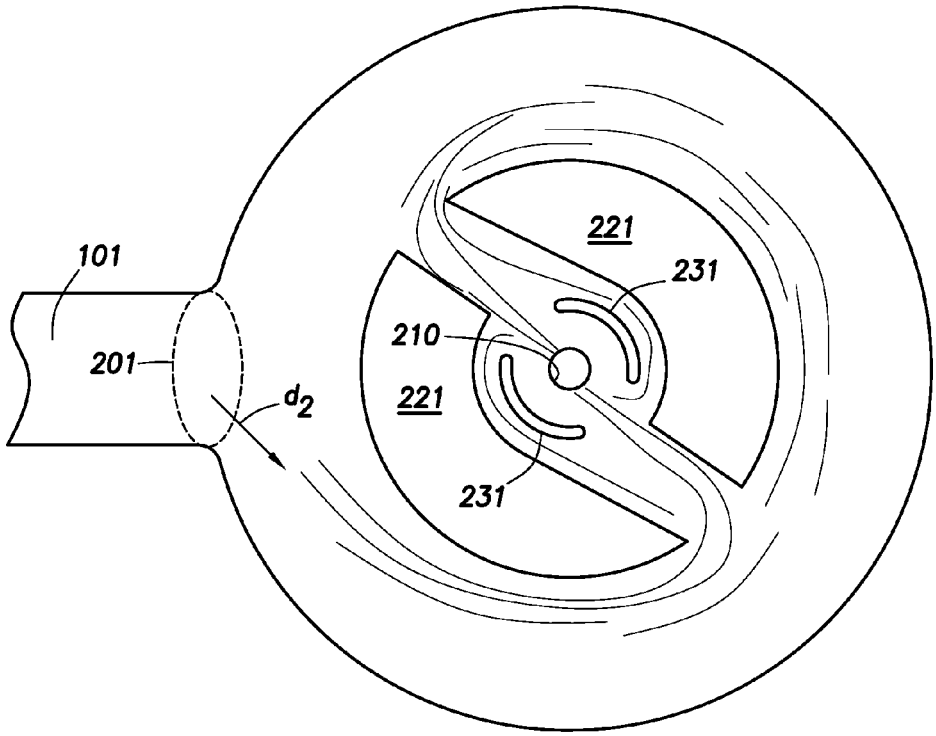

FIGS. 3C, 4C, and 5C illustrate certain embodiments of the flow of a fluid about the exit assembly 200 when at least some of the fluid enters the assembly 200 in the direction of $d_2$. As discussed above, the fluid can be directed into the third fluid passageway 103 by the fluid switch 300, enter the exit assembly 200 via the second fluid inlet 201, and flow in the direction of $d_2$. As also discussed above, the fluid can enter the exit assembly 200 via the first fluid inlet 201 and flow in the direction of $d_2$. According to an embodiment, as the fluid increasingly flows in the direction of $d_2$, the fluid decreasingly flows rotationally about the exit assembly 200. Accordingly, the fluid flows about the assembly 200 in another direction (depicted as $d_2$) and at least some of the fluid can contact the at least one boundary of the fluid director 221 that impedes flow of the fluid rotationally about the assembly 200. If there is more than one fluid director 221, then some of the fluid can flow around a first fluid director 221 in the outer region, and at least some of that fluid can contact another boundary of a second fluid director 221 that impedes flow of the fluid rotationally about the assembly 200. The fluid that contacts the boundary(ies) that impedes rotational flow, can enter the inner region between the boundary(ies) and the first fluid outlet 210. In a preferred embodiment, the fluid decreasingly flows rotationally about the first fluid outlet 210 in the inner region. It is preferred that the fluid enter the inner region substantially radially with respect to the first fluid outlet 210. The exit assembly 200 can also include at least one flow director 231. The flow director 231 can be positioned in the inner region. In this manner, the fluid that enters the space, can contact at least one boundary of the flow director 231. The flow director 231 can help maintain a non-rotational flow of the fluid about the first fluid outlet 210. The fluid director 221 and the flow director 231 can decrease the rotational flow of the fluid about the exit assembly 200 and/or about the first fluid outlet 210.

According to an embodiment, as the fluid decreasingly flows rotationally about the exit assembly 200, the resistance to flow of the fluid through the assembly 200 decreases. According to another embodiment, as the fluid decreasingly flows rotationally about the first fluid outlet 210, the resistance to flow of the fluid through the outlet 210 decreases. Accordingly, a fluid entering the exit assembly 200 in the direction of $d_2$ (compared to a fluid entering in the direction of $d_1$) can experience: a decreasing rotational flow about the assembly; less resistance to flow about the assembly; and less of a change in the flow rate of the fluid exiting the first fluid outlet 210 compared to the flow rate of the fluid entering the flow rate restrictor 25.

Figure 8:
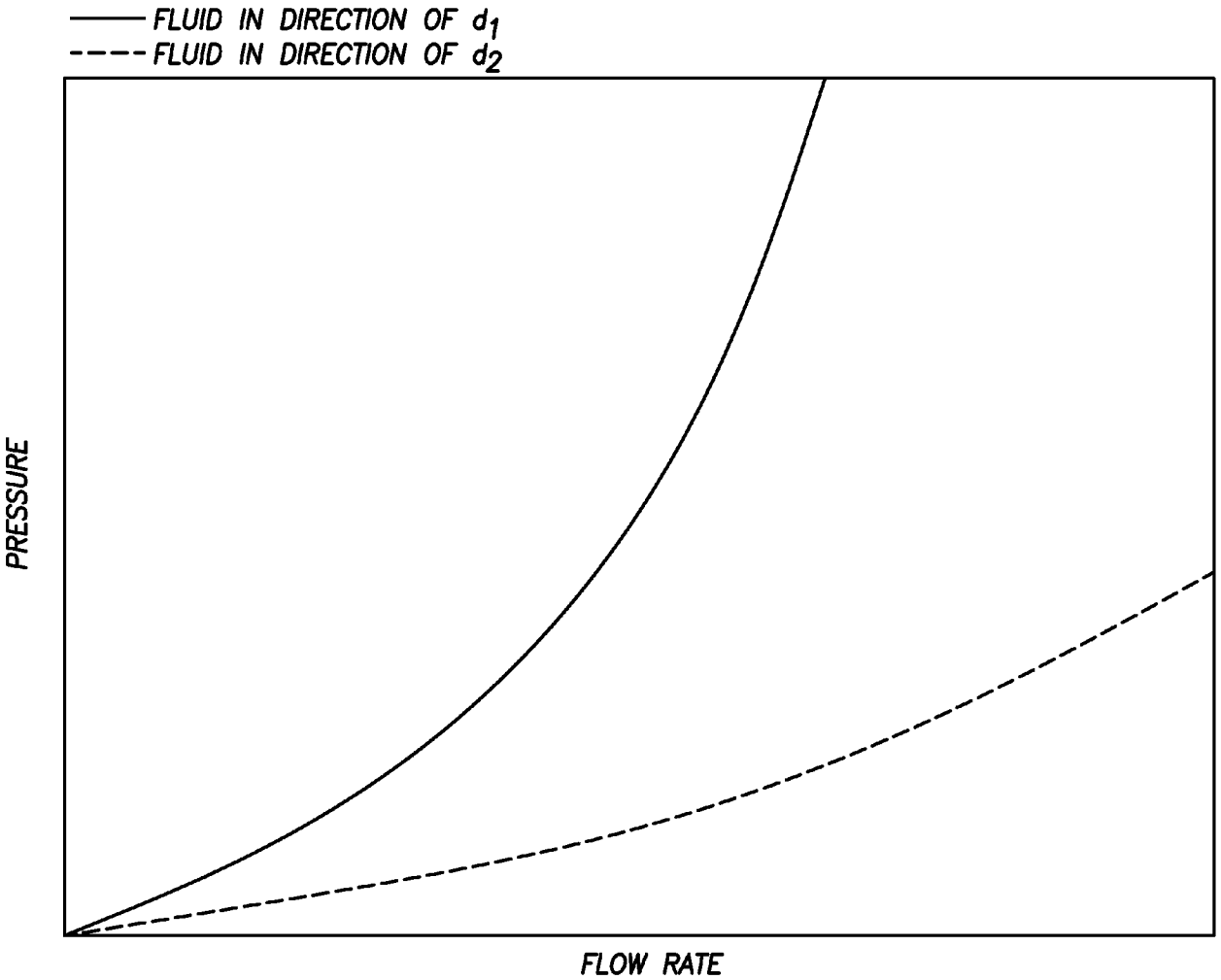
FIG. 8 is a graph of pressure versus flow rate of a fluid through an exit assembly when the fluid enters the assembly in two different directions.

FIG. 8 is a graph of pressure versus flow rate of a fluid through the exit assembly 200. The two lines depict the difference in the resistance of a fluid to flow through exit assembly when the fluid enters the assembly in two different directions. The solid line represents a fluid entering the exit assembly 200 in the direction of $d_1$ and the dashed line represents a fluid entering the exit assembly 200 in the direction of $d_2$. As can be seen in FIG. 8, the resistance to flow of a fluid entering in the direction of $d_1$ is greater than the resistance to flow of a fluid entering in the direction of $d_2$.

The components of the exit assembly 200 can be made from a variety of materials. Examples of suitable materials include, but are not limited to: metals, such as steel, aluminum, titanium, and nickel; alloys; plastics; composites, such as fiber reinforced phenolic; ceramics, such as tungsten carbide, boron carbide, synthetic diamond, or alumina; elastomers; and dissolvable materials.

Figure 9:
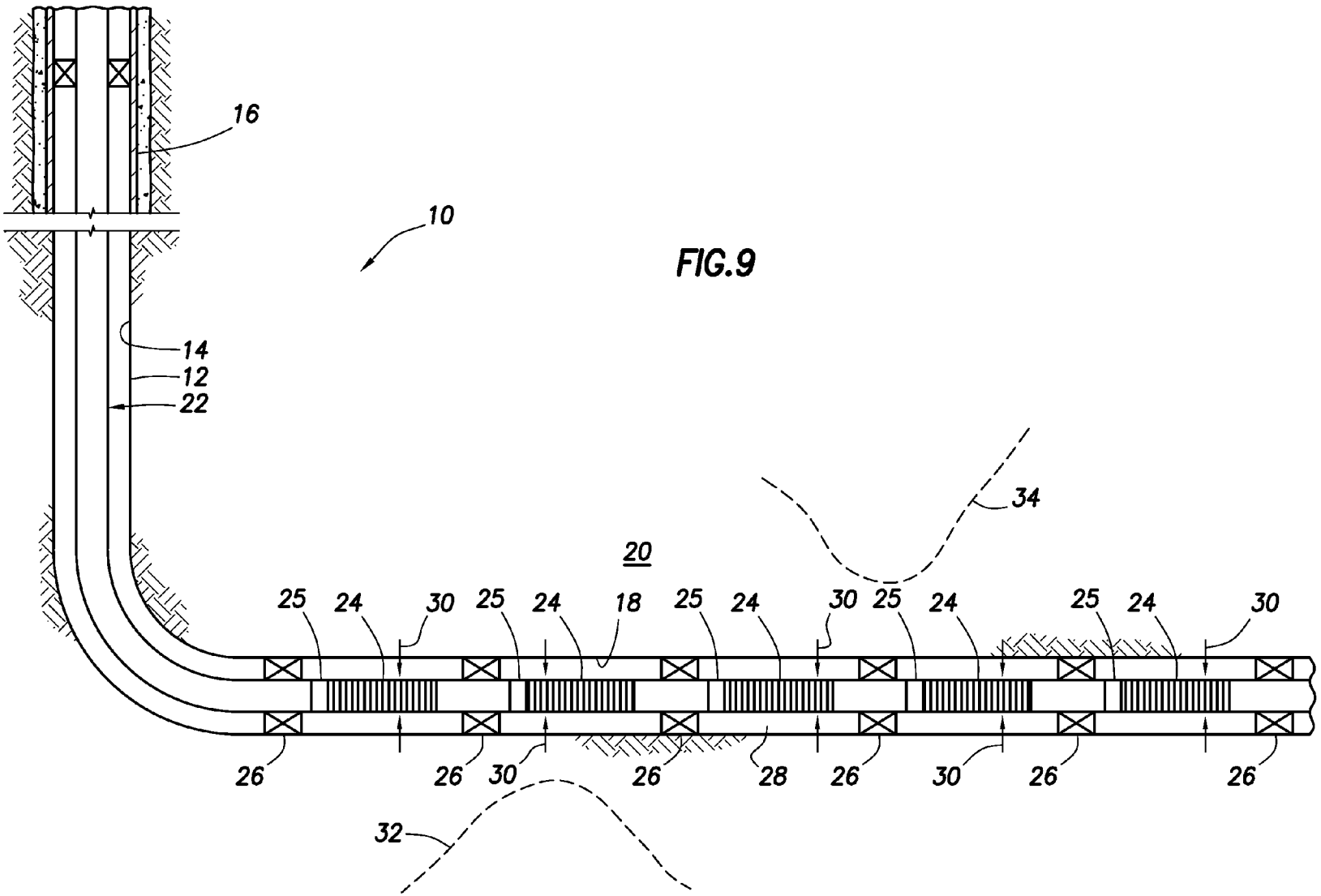
FIG. 9 is a well system containing at least one of the flow rate restrictors depicted in FIG. 1 or 2.

The flow rate restrictor 25 can be used any place where the variable restriction or regulation of the flow rate of a fluid is desired. According to an embodiment, the flow rate restrictor 25 is used in a subterranean formation. According to another embodiment, the subterranean formation is penetrated by at least one wellbore. The subterranean formation can be a portion of a reservoir or adjacent to a reservoir. FIG. 9 is a well system 10 which can encompass certain embodiments. As depicted in FIG. 9, a wellbore 12 has a generally vertical uncased section 14 extending downwardly from a casing 16, as well as a generally horizontal uncased section 18 extending through a subterranean formation 20.

A tubing string 22 (such as a production tubing string) is installed in the wellbore 12. Interconnected in the tubing string 22 are multiple well screens 24, flow rate restrictors 25, and packers 26.

The packers 26 seal off an annulus 28 formed radially between the tubing string 22 and the wellbore section 18. In this manner, a fluid 30 may be produced from multiple zones of the formation 20 via isolated portions of the annulus 28 between adjacent pairs of the packers 26.

Positioned between each adjacent pair of the packers 26, a well screen 24 and a flow rate restrictor 25 are interconnected in the tubing string 22. The well screen 24 filters the fluid 30 flowing into the tubing string 22 from the annulus 28. The flow rate restrictor 25 regulates the flow rate of the fluid 30 into the tubing string 22, based on certain characteristics of the fluid, e.g., the flow rate of the fluid entering the flow rate restrictor 25, the viscosity of the fluid, or the density of the fluid. In another embodiment, the well system 10 is an injection well and the flow rate restrictor 25 regulates the flow rate of fluid 30 out of tubing string 22 and into the formation 20.

It should be noted that the well system 10 is illustrated in the drawings and is described herein as merely one example of a wide variety of well systems in which the principles of this disclosure can be utilized. It should be clearly understood that the principles of this disclosure are not limited to any of the details of the well system 10, or components thereof, depicted in the drawings or described herein. Furthermore, the well system 10 can include other components not depicted in the drawing. For example, cement may be used instead of packers 26 to isolate different zones. Cement may also be used in addition to packers 26.

By way of another example, the wellbore 12 can include only a generally vertical wellbore section 14 or can include only a generally horizontal wellbore section 18. The fluid 30 can be produced from the formation 20, the fluid could also be injected into the formation, and the fluid could be both injected into and produced from the formation. The system can be used during any phase of the life of a well including, but not limited to, the drilling, evaluation, stimulation, injection, completion, production, and decommissioning of a well.

The well system does not need to include a packer 26. Also, it is not necessary for one well screen 24 and one flow rate restrictor 25 to be positioned between each adjacent pair of the packers 26. It is also not necessary for a single flow rate restrictor 25 to be used in conjunction with a single well screen 24. Any number, arrangement and/or combination of these components may be used. Moreover, it is not necessary for any flow rate restrictor 25 to be used in conjunction with a well screen 24. For example, in injection wells, the injected fluid could be flowed through a flow rate restrictor 25, without also flowing through a well screen 24. There can be multiple flow rate restrictors 25 connected in fluid parallel or series.

It is not necessary for the well screens 24, flow rate restrictor 25, packers 26 or any other components of the tubing string 22 to be positioned in uncased sections 14, 18 of the wellbore 12. Any section of the wellbore 12 may be cased or uncased, and any portion of the tubing string 22 may be positioned in an uncased or cased section of the wellbore, in keeping with the principles of this disclosure.

It will be appreciated by those skilled in the art that it would be beneficial to be able to regulate the flow rate of the fluid 30 entering into the tubing string 22 from each zone of the formation 20, for example, to prevent water coning 32 or gas coning 34 in the formation. Other uses for flow regulation in a well include, but are not limited to, balancing production from (or injection into) multiple zones, minimizing production or injection of undesired fluids, maximizing production or injection of desired fluids, etc.

Referring now to FIGS. 1 and 4, the flow rate restrictor 25 can be positioned in the tubing string 22 in a manner such that the fluid 30 enters the flow rate restrictor 25 and travels through the first fluid passageway 101. For example, in a production well, the restrictor 25 may be positioned such that the opening to the first fluid passageway 101 is functionally oriented towards the formation 20. Therefore, as the fluid 30 flows from the formation 20 into the tubing string 22, the fluid 30 will enter the first fluid passageway 101. By way of another example, in an injection well, the restrictor 25 may be positioned such that the flow rate restrictor 25 is functionally oriented towards the tubing string 22. Therefore, as the fluid 30 flows from the tubing string 22 into the formation 20, the fluid 30 will enter the first fluid passageway 101.

An advantage for when the flow rate restrictor 25 is used in a subterranean formation 20, is that it can help regulate the flow rate of a fluid within a particular zone and also regulate the flow rates of a fluid between two or more zones. Another advantage is that the flow rate restrictor 25 can help solve the problem of production of a heterogeneous fluid. For example, if oil is the desired fluid to be produced, the exit assembly 200 can be designed such that if water enters the flow rate restrictor 25 along with the oil, then the exit assembly 200 can reduce the flow rate of the fluid exiting via the first fluid outlet 210 based on the decrease in viscosity of the fluid. The versatility of the exit assembly 200 allows for specific problems in a formation to be addressed.

The flow resistance through the flow rate restrictor 25 can be sized to alternately increase and decrease, causing the backpressure to alternately be increased and decreased in response. This backpressure can be useful, since in the well system 10 it will result in pressure pulses being propagated from the flow rate restrictor 25 upstream into the annulus 28 and formation 20 surrounding the tubular string 22 and wellbore section 18.

Pressure pulses transmitted into the formation 20 can aid production of the fluids 30 from the formation, because the pressure pulses help to break down "skin effects" surrounding the wellbore 12, and otherwise enhance mobility of the fluids in the formation. By making it easier for the fluids 30 to flow from the formation 20 into the wellbore 12, the fluids can be more readily produced (e.g., the same fluid production rate will require less pressure differential from the formation to the wellbore, or more fluids can be produced at the same pressure differential, etc.).

The alternating increases and decreases in flow resistance through the flow rate restrictor 25 can also cause pressure pulses to be transmitted downstream of the first fluid outlet 210. These pressure pulses downstream of the first fluid outlet 210 can be useful, for example, in circumstances in which the flow rate restrictor 25 is used for injecting the fluid 30 into a formation.

In these situations, the injected fluid would be flowed through the flow rate restrictor 25 from the opening to the first fluid passageway 101 to the first fluid outlet 210, and thence into the formation. The pressure pulses would be transmitted from the outlet 210 into the formation as the fluid 30 is flowed through the flow rate restrictor 25 and into the formation. As with production operations, pressure pulses transmitted into the formation are useful in injection operations, because they enhance mobility of the injected fluids through the formation.

Other uses for the pressure pulses generated by the flow rate restrictor 25 are possible, in keeping with the principles of this disclosure. In another example, pressure pulses are used in a gravel packing operation to reduce voids and enhance consolidation of gravel in a gravel pack.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present invention. While compositions and methods are described in terms of "comprising," "containing," or "including" various components or steps, the compositions and methods also can "consist essentially of" or "consist of" the various components and steps. Whenever a numerical range with a lower limit and an upper limit is disclosed, any number and any included range falling within the range is specifically disclosed. In particular, every range of values (of the form, "from about a to about b," or, equivalently, "from approximately a to b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an", as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. An exit assembly comprising:

a first fluid inlet;

a first fluid outlet; and at least one fluid director, wherein a fluid enters the exit assembly in one direction, in another direction, or combinations thereof, wherein the at least one fluid director induces flow of the fluid rotationally about the assembly when the fluid enters in the one direction and impedes flow of the fluid rotationally about the assembly when the fluid enters in the another direction, and wherein the at least one fluid director is located adjacent to the fluid outlet and at least partially surrounds the fluid outlet.

2. The assembly according to claim 1, wherein the fluid has a vector component that enters the assembly tangentially relative to a radius of the first fluid outlet.

3. The assembly according to claim 1, wherein the size and shape of the at least one fluid director is selected such that the fluid director induces the flow of the fluid rotationally about the assembly when the fluid enters in the one direction and impedes the flow of the fluid rotationally about the assembly when the fluid enters in the another direction.

4. The assembly according to claim 1, wherein the fluid director includes at least three boundaries.

5. The assembly according to claim 4, wherein at least one of the boundaries induces flow of a fluid rotationally about the assembly.

6. The assembly according to claim 5, wherein another one of the boundaries impedes flow of a fluid rotationally about the assembly.

7. The assembly according to claim 6, further comprising a first fluid director and a second fluid director, and wherein the at least one boundary that induces rotational flow of a fluid of the first fluid director opposes the another one of the boundaries that impedes rotational flow of the fluid of the second fluid director and the another one of the boundaries that impedes rotational flow of the fluid of the first fluid director opposes the at least one boundary that induces rotational flow of the fluid of the second fluid director.

8. The assembly according to claim 7, wherein there is at least one opening between the first and second fluid directors.

9. The assembly according to claim 1, further comprising at least one flow director.

10. The assembly according to claim 9, wherein the flow director helps to maintain a rotational flow of a fluid about the assembly and wherein the flow director helps to maintain a non-rotational flow of a fluid about the assembly.

11. The assembly according to claim 10, wherein the flow director has a shape selected such that the flow director helps to maintain a rotational flow of a fluid about the assembly and helps to maintain a non-rotational flow of a fluid about the assembly.

12. The assembly according to Claim 9, wherein the shape of the flow director is substantially the same shape as the fluid director.

13. The assembly according to claim 1, wherein based on at least one of the properties of the fluid, the fluid increasingly flows in the one direction.

14. The assembly according to claim 13, wherein as the fluid increasingly flows in the one direction, the fluid increasingly flows rotationally about the assembly.

15. The assembly according to claim 14, wherein as the fluid increasingly flows rotationally about the assembly, the resistance to flow of the fluid through the assembly increases.

16. The assembly according to claim 1, wherein based on at least one of the properties of the fluid, the fluid increasingly flows in the another direction.

17. The assembly according to claim 16, wherein as the fluid increasingly flows in the another direction, the fluid decreasingly flows rotationally about the assembly.

18. The assembly according to claim 17, wherein as the fluid decreasingly flows rotationally about the assembly, the resistance to flow of the fluid through the assembly decreases.

19. The assembly according to claim 1, further comprising a second fluid inlet.

20. The assembly according to claim 19, wherein the fluid entering the assembly via the first fluid inlet is entering in the one direction and the fluid entering the assembly via the second fluid inlet is entering in the another direction.

21. The assembly according to claim 1, wherein the exit assembly is used in a flow rate restrictor.

22. A flow rate restrictor comprises:

a fluid switch;

an exit assembly comprising:

(1) a first fluid inlet;

(2) a first fluid outlet; and (3) at least one fluid director, wherein the fluid switch causes a fluid to enter the exit assembly in one direction, in another direction, or combinations thereof, wherein the at least one fluid director induces flow of the fluid rotationally about the assembly when the fluid enters in the one direction and impedes flow of the fluid rotationally about the assembly when the fluid enters in the another direction, and wherein the at least one fluid director is located adjacent to the fluid outlet and at least partially surrounds the fluid outlet.

23. The restrictor according to claim 22, further comprising a first fluid passageway.

24. The restrictor according to claim 23, further comprising a second fluid passageway and a third fluid passageway.

25. The restrictor according to claim 24, further comprising a branching point wherein the first fluid passageway branches into the second and third fluid passageways at the branching point.

26. The restrictor according to claim 24, wherein the fluid switch directs the fluid into at least the second fluid passageway, the third fluid passageway, or combinations thereof

27. The restrictor according to claim 26, wherein when the fluid switch directs the fluid into the second fluid passageway, the fluid enters the exit assembly in the one direction.

28. The restrictor according to claim 26, wherein when the fluid switch directs the fluid into the third fluid passageway, the fluid enters the exit assembly in the another direction.

29. The restrictor according to claim 22, wherein the restrictor is for use in a subterranean formation.

30. The restrictor according to claim 22, wherein the restrictor is used to create pressure pulses in at least a portion of the subterranean formation.

* * * * *

UNITED STATES PATENT AND TRADEMARK OFFICE

CERTIFICATE OF CORRECTION

PATENT NO. : 8,555,975 B2
APPLICATION NO. : 12/974212
DATED : October 15, 2013
INVENTOR(S) : Jason D. Dykstra and Michael L. Fripp It is certified that error appears in the above-identified patent and that said Letters Patent is hereby corrected as shown below:

On the Title page: Item (74) Attorney, Agent, or Firm – Paul Herman; Sheri Higgins Law; Sherri Higgins. The name "Sherri" is misspelled. Please correct the spelling of "Sherri" to Sheri.

Signed and Sealed this
Twenty-second Day of April, 2014

Michelle K. Lee

Michelle K. Lee
*Deputy Director of the United States Patent and Trademark Office*